US005297404A

United States Patent [19]

Embry

[11] Patent Number: 5,297,404

[45] Date of Patent: Mar. 29, 1994

[54] BOLT FOR AN INNER CYLINDER LOCK

[75] Inventor: Donald J. Embry, Cloverport, Ky.

[73] Assignee: HSL Marketing, Inc., Atlanta, Ga.

[21] Appl. No.: 119,817

[22] Filed: Sep. 13, 1993

Related U.S. Application Data

[63] Continuation of Ser. No. 909,171, Jul. 6, 1992, abandoned.

[51] Int. Cl.[5] ..... E05B 63/00

[52] U.S. Cl. ..... 70/1.5; 70/416; 292/150; 292/169.14; 292/DIG. 51

[58] Field of Search ..... 70/1.5, 1.7, 333 R, 70/416; 292/150, 169.14, DIG. 55, 1.37, 163, DIG. 51

[56] References Cited

U.S. PATENT DOCUMENTS

| | | | |
|---|---|---|---|
| 1,691,030 | 11/1928 | Benham et al. | 70/422 |
| 3,671,065 | 6/1972 | Bingham | 292/DIG. 30 |
| 3,919,866 | 11/1975 | Lipschutz | 70/81 |
| 4,074,548 | 2/1978 | Milton | 70/1.5 |
| 4,143,528 | 3/1979 | Weber et al. | 70/1.5 |
| 4,183,565 | 1/1980 | Alleman | 292/DIG. 66 |
| 4,611,477 | 9/1986 | Crites | 70/416 |
| 4,648,255 | 3/1987 | Gartner | 70/1.5 |
| 4,788,839 | 12/1988 | Shuler | 70/416 |
| 4,961,328 | 10/1990 | Mundhenke | 70/416 |
| 4,977,768 | 12/1990 | Embry | 70/491 |

*Primary Examiner*—Peter M. Cuomo
*Assistant Examiner*—Darnell M. Boucher
*Attorney, Agent, or Firm*—Richard C. Litman

[57] ABSTRACT

The present invention is an improvement on an inner cylinder lock and more specifically, on the bolt thereof. The bolt engages an opening in the rear case of the inner cylinder lock. The improvement on the bolt prevents the bolt from moving in a lateral direction and restricts the travel of the bolt in a direction transverse to the lateral direction. This is accomplished by providing two generally rectangular projecting members, each of which extends from opposite sides of the bolt. The projecting members fit into accommodating channels which are disposed within the opening in the rear case. The bolt also has a cavity located in its rear. The purpose of the cavity is to receive a spring biased locking pin. The spring biased locking pin is located in the posterior wall of the rear case. During normal operation, the bolt is limited in its travel by a pin engages the bolt. The projecting members prevent lateral movement of the bolt. And, if the portion of the lock anterior to the bolt is removed by force, and the pin pried out of its engagement with the bolt, the bolt will be biased towards and through the opening in the rear case and the locking pin in the posterior wall of the rear case will engage the cavity in the rear of the bolt, and thus prevent the bolt from being moved in a direction transverse to the lateral direction.

5 Claims, 2 Drawing Sheets

BOLT FOR AN INNER CYLINDER LOCK

CROSS-REFERENCE TO RELATED APPLICATION

This application is a continuation of application Ser. No. 07/909,171; filed Jul. 6, 1992 now abandoned.

BACKGROUND OF THE INVENTION

1. Field of the Invention

The present invention relates to inner cylinder locks and more specifically, to a modification in a bolt of the inner cylinder lock. This modification or improvement in the bolt reduces the risk of the unauthorized opening of the inner cylinder lock even if the forward case of the lock is removed.

2. Description of the Prior Art

Inner cylinder locks are well known in the art, and various methods have been proposed to prevent unauthorized access into the areas or enclosures that they protect.

U.S. Pat. No. 4,143,528 issued on Mar. 13, 1979 to Gunter Weber et al. discloses an anti-theft locking device wherein if the locking cylinder is removed by an unauthorized person, a lever that abuts the cylinder is freed to swivel, thus releasing a spring biased bolt that moves into the locked position.

In my prior U.S. Pat. No. 4,977,768 issued on Dec. 18, 1990, a pick resistant axial split-pin tumbler lock is disclosed. A bolt is movable in the rear case of the lock into a locked or unlocked position, but no provision is made to prevent unauthorized access to the secured enclosure by simply removing the entire front casing of the inner cylinder lock.

None of the above inventions and patents, taken either singly or in combination, is seen to describe the instant invention as claimed.

SUMMARY OF THE INVENTION

Losses are absorbed every day by owners of vending machines and those desiring to secure areas or equipment. A number of pick-proof locks have been proposed to alleviate the situation, but these inventions do not address the possibility of a thief merely breaking and removing the front portion of the lock assembly, thereby gaining access to the bolt. The present invention is an improvement to an inner cylinder lock, such as the inner cylinder lock shown in on my previously issued patent, mentioned above, where the bolt that engages an opening in the rear case has two additional generally rectangular projecting members, each extending from an opposite side thereof. These projecting members fit into channels that are disposed in the opening in the rear case. The bolt also has a cavity in its rear for engagement of a spring biased locking pin which is included in a posterior wall of the rear case of the lock. During normal operation, the bolt is limited in its travel in a lateral direction by the engagement of the projecting members with the respective channels. Further, a pin protruding from a cam member or, in the absence of a cam member, a pin protruding from the rear end of a forward portion of inner cylinder lock engages the edges of a cut-out in the bolt. If, however, the forward portion or portions of the lock anterior to the bolt is removed from the rear case by force and the pin pried out of its engagement with the bolt, the bolt biases towards and through the opening in the rear case and the spring based pin in the posterior wall of the rear case engages the cavity in the rear of the bolt, thus preventing the bolt from being moved in a direction transverse to the lateral direction.

Accordingly, it is a principal object of the invention to provide an improvement for the bolt on an inner cylinder lock which prevents unauthorized access to an area or enclosure secured by the lock.

It is another object of the invention to secure the area or enclosure protected by the lock, where, if the portion or portions of the lock anterior to the bolt are removed, the bolt is moved into a locking position and held there with a spring biased pin, requiring the bolt to be drilled out of the rear case of the lock to gain access to the area being secured.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
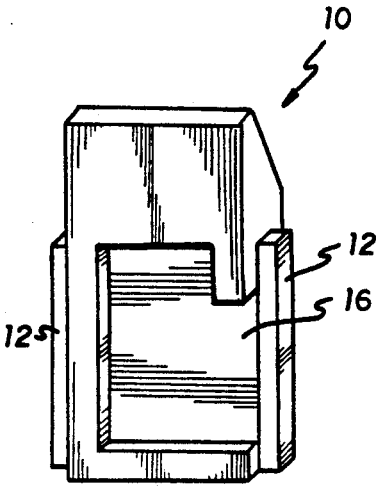
FIG. 1 is a front perspective view of the improved bolt for an inner cylinder lock.
Figure 2:
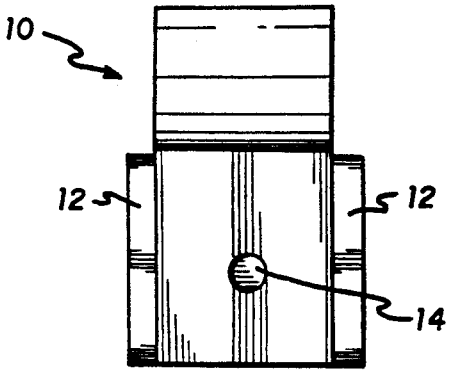
FIG. 2 is a rear elevational view of the improved bolt for an inner cylinder lock.
Figure 3:
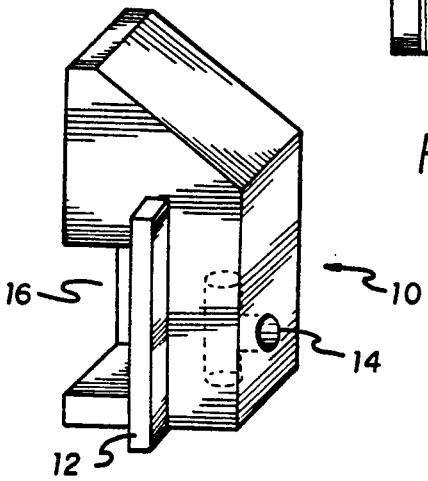
FIG. 3 is a side perspective view of the improved bolt for an inner cylinder lock.
Figure 4:
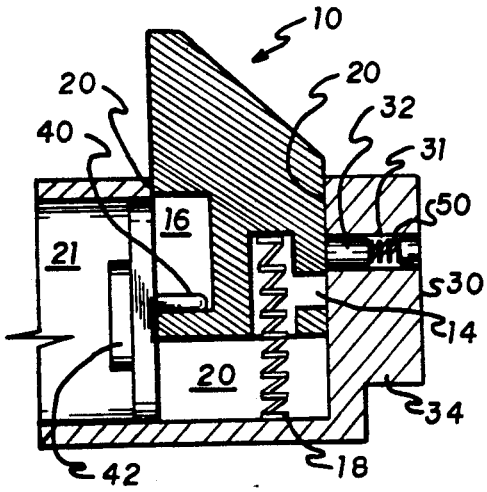
FIG. 4 is an environmental cutaway side view of the improved bolt, the rear casing, and the forward portion of the inner cylinder in a normal locked position.
Figure 5:
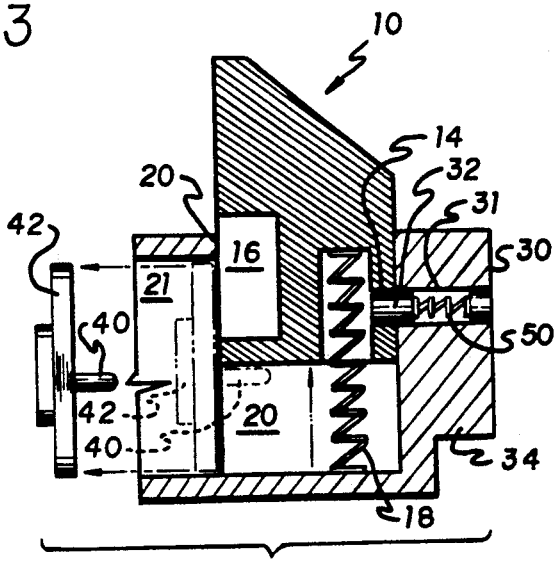
FIG. 5 is an environmental cutaway side view of the improved bolt, the rear casing, and the forward portion of the inner cylinder in the augmented position that the assembly assumes when the forward portion of the inner cylinder lock is removed from its engagement with the cut out in the bolt.
Figure 6:
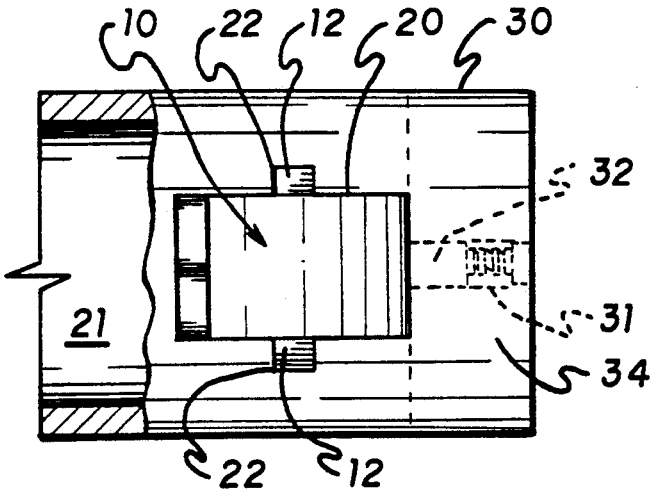
FIG. 6 is a partial cutaway top elevational view showing the channels adjacent to the opening in the rear case and the phantom lines, showing the position of the spring biased pin in the posterior wall of the rear casing.

The present invention is an improvement on an inner cylinder lock, such as the inner cylinder lock described in my previously issued U.S. Pat. No. 4,977,768, mentioned above, and more particularly, an improvement on the bolt thereof. Hereinafter, the term bolt 10 will refer to the improved bolt. The bolt 10 engages an opening 20 in a rear case 30. The bolt 10 has two generally rectangular projecting members 12 located on opposite sides thereof. These projecting members 12 are slidable engagable with accommodating channels 22 that are disposed on opposite sides of the opening 20. It is be understood that the channels 22 could be located in the bolt 10 and the projecting members 12 could extend interiorly of the opening 20 without affecting the operation of the inner cylinder lock (not shown). The bolt 10 also has a cavity 14 disposed within the rear thereof for engagement by a locking pin 32 biased by a compression spring after "32". The spring biased locking pin 32 is slidable disposed in an opening 31 in a posterior wall 34 of the rear case 30. Moreover, the cavity 14 could be located in the rear case 30 and the spring biased locking pin 32 could be disposed within the bolt 10 without affecting the operation of the inner cylinder lock (not shown) as long as neither the cavity 14 nor the locking pin 32 are exposed. During normal operation, the bolt 10 is limited in its travel by a pin 40 which protrudes from a cam member 42 located in a bore or opening 21 in the rear case 30, or in the absence of a cam member 42, which protrudes from the rear end of a forward portion of inner cylinder lock (not shown). The pin 40 engages with the peripheral edges of a cut-out 16 in the bolt 10, disengaging the bolt 10 through the opening 20 in the rear case 30 and allowing access to the area or enclosure. If, however, the portion of the inner cylinder lock (not shown) anterior to the bolt 10 is removed by force, and the pin 40 pried out of its engagement with the rear case 30 and bolt 10, a compression spring 18, housed interiorly of the bolt 10 biases the bolt 10 through the opening 20, allowing the spring biased locking pin 32 in the posterior wall 34 of the rear case 30 to engage with the cavity 14 in the rear of the bolt 10, thus preventing the bolt 10 from being moved into the unlocked position. Additionally, the generally rectangular projecting members 12 on the opposite sides of the bolt 10 are accommodated in the channels 22 adjacent to the opening 20 in the rear case 30, preventing lateral movement of the bolt 10.

It is to be further understood that the present invention is not limited to the sole embodiment described above, but encompasses any and all embodiments within the scope of the following claims.

I claim:

1. An inner cylinder lock comprising:

a rear case having a plurality of walls defining a first opening and at least one groove, a second opening, and a third opening, said first opening, said second opening, and said third opening being connected to each other;

a bolt, movably accommodated in said first opening of said rear case, said bolt sealing said third opening of said rear case when located at a first position, and said bolt having a cavity connectable to said third opening of said rear case when said bolt is located at a second position, said bolt comprises at least one projecting member engaged with said groove of said rear case, whereby an engagement between said projecting member and said groove defines a moving direction of said bolt as said direction from said first position to said second position;

a cam pin, removably accommodated in said second opening of said rear case, which retains said bolt to be located at the first position;

first biasing means, accommodated in said first opening of said rear case and coupled to said bolt, for biasing said bolt so as to move said bolt in a direction from said first position to said second position in said first opening;

a locking pin, accommodated in said third opening of said rear case and engageable with said cavity of said bolt; and second biasing means, accommodated in said third opening of said rear case and coupled to said locking pin, for biasing said locking pin so as to project said locking pin through said first opening of said rear case and to engage said locking pin with said cavity of said bolt, whereby when said cam pin is removed, said bolt is moved from said first position to said second position by said first biasing means and retained at the second position by means of an engagement between said cavity thereof and said locking pin projected by said second biasing means.

2. The inner cylinder lock according to claim 1, wherein said first biasing means comprises a compression spring.

3. The inner cylinder lock according to claim 1, wherein said second biasing means comprises a compression spring.

4. The inner cylinder lock according to claim 1, wherein said plurality of walls of said rear case have two opposite grooves, and wherein said bolt has two opposite projecting members each of said opposite projecting members is engaged with a corresponding one of said two opposite grooves.

5. An inner cylinder lock comprising:

a rear case having a plurality of walls defining a first opening, a second opening, and a third opening located opposite from said second opening;

a bolt movably located within in said first opening of said rear case, said bolt sealing said third opening of said rear case when located at a first position, and said bolt including a cavity connected opening into said third opening of said rear case when said bolt is located at a second position;

a cam pin removably accommodated in said second opening of said rear case and configured so said bolt is located at the first position, when said cam pin engages said bolt;

first biasing means, accommodated in said first opening of said rear case and coupled to said bolt, for biasing said bolt toward said second position, so said bolt moves in a first direction;

a locking pin, accommodated in said third opening of said rear case and engageably with said cavity of said bolt; and second biasing means, accommodated in said third opening of said rear case and coupled to said locking pin, for biasing said locking pin so said locking pin moves in a second direction substantially perpendicular to the first direction and through said first opening of said rear case and to engage said locking pin with said cavity of said bolt, whereby when said cam pin is removed, said bolt is moved from said first position to said second position by said first biasing means and retained at the second position by an engagement between said cavity thereof and said locking pin projected by said second biasing means.

* * * * *